US006293657B1

(12) United States Patent
Garcia et al.

(10) Patent No.: US 6,293,657 B1
(45) Date of Patent: Sep. 25, 2001

(54) MID PLOT REFILL TECHNIQUE FOR LARGE SCALE PRINTERS

(75) Inventors: Javier Salvador Lagares Garcia, Sant Cugat; David H. Donovan, Barcelona, both of (ES)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/183,348

(22) Filed: Oct. 30, 1998

(51) Int. Cl.[7] ..... B41J 2/17
(52) U.S. Cl. ..... 347/84
(58) Field of Search ..... 347/84, 85, 7, 347/41, 5, 9, 12, 40, 16, 101; 400/249; 395/113; 358/1–14

(56) References Cited

U.S. PATENT DOCUMENTS 4,187,511 * 2/1980 Robinson ..... 347/7
4,943,813 * 7/1990 Palmer et al. ..... 347/41
5,751,312 * 5/1998 Gibson ..... 347/43
5,914,731 * 6/1999 Yano et al. ..... 347/9
6,007,181 * 1/2000 Takahashi et al. ..... 347/41
6,015,201 * 1/2000 Asakura ..... 347/19
6,106,108 * 8/2000 Cluet ..... 347/84

* cited by examiner

*Primary Examiner*—N. Le
*Assistant Examiner*—Michael Nguyen

(57) ABSTRACT

Techniques for pausing and resuming printing operations in mid-plot while reducing visible artifacts. A pause row/swath location is determined at which printing is to be paused. In one pause/resume mode, printing of all rows and all pixels from commencement of printing through the row location is completed, and no pixels in rows immediately following the row location are printed. The printing is paused for a time interval, and operations such as a pen refill can be performed. Printing is resumed at a resume row location immediately following the pause row location to print only rows following the pause row, wherein wet ink is not applied to locations printed prior to the pausing. In another pause/resume mode, in a multi-pass print of an image, the pause occurs upon completion of a pass without completing all printing prior to the pause row. Following the pause interval, printing is resumed, as though a pause had not occurred. The pause/resume mode is selected in dependence on print parameters, including media type and print quality.

20 Claims, 6 Drawing Sheets

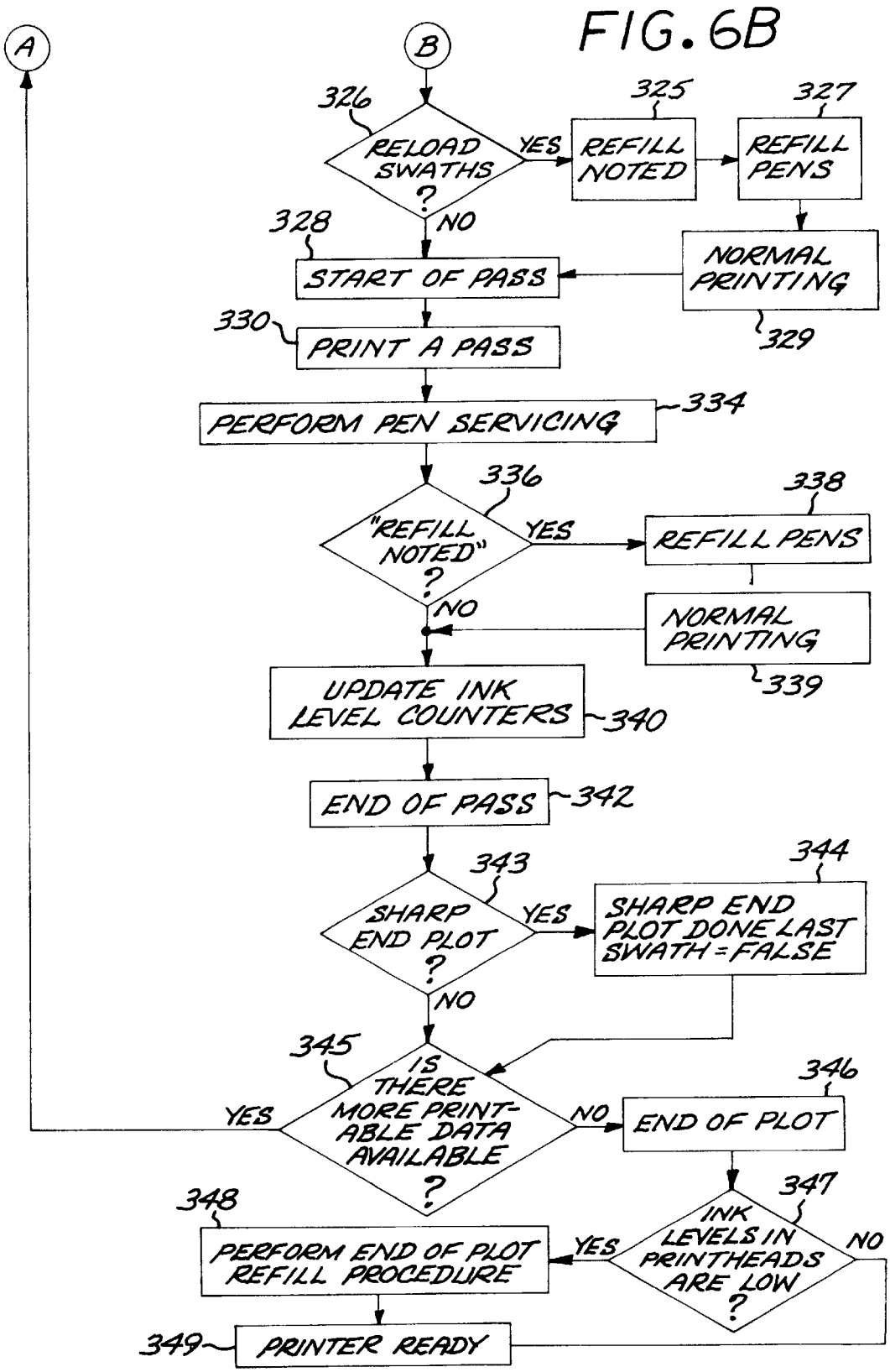
FIG. 6B
A
B
326
RELOAD SWATHS ?
YES
NO
325
REFILL NOTED
327
REFILL PENS
328
START OF PASS
NORMAL PRINTING
329
330
PRINT A PASS
PERFORM PEN SERVICING
334
336
"REFILL NOTED" ?
YES
NO
338
REFILL PENS
NORMAL PRINTING
339
UPDATE INK LEVEL COUNTERS
340
END OF PASS
342
343
SHARP END PLOT ?
YES
NO
344
SHARP END PLOT DONE LAST SWATH = FALSE
345
IS THERE MORE PRINTABLE DATA AVAILABLE ?
YES
NO
346
END OF PLOT
347
INK LEVELS IN PRINTHEADS ARE LOW ?
YES
NO
348
PERFORM END OF PLOT REFILL PROCEDURE
349
PRINTER READY

MID PLOT REFILL TECHNIQUE FOR LARGE SCALE PRINTERS

CROSS-REFERENCE TO RELATED APPLICATIONS

This application is related to the following commonly assigned, applications, the entire contents of which are incorporated herein by this reference:

- ADAPTIVE IMAGE-BASED TECHNIQUE FOR REFILL-WHILE-PRINTING TRIGGERING, by Miquel Cluet. U.S. aplication Ser. No. 09,183,129, filed Oct. 30, 1998 now U.S. Pat. No. 6,106,108
- SPACE-EFFICIENT ENCLOSURE SHAPE FOR NESTING TOGETHER A PLURALITY OF REPLACEABLE INK SUPPLY BAGS, by Erich Coiner et al. U.S. application Ser. No. 08/805,860, filed Mar. 3, 1997 now U.S. Pat. No. 6,030,073
- PRINTING SYSTEM WITH SINGLE ON/OFF CONTROL VALVE FOR PERIODIC INK REPLENISHMENT OF PRINTHEAD, by Max S. Gunther et al. U.S. application Ser. No. 08/810,840, filed Mar. 3, 1997 now U.S. Pat. No. 5,929,883
- PRINTER APPARATUS FOR PERIODIC AUTOMATED CONNECTION OF INK SUPPLY VALVES WITH MULTIPLE PRINTHEADS, by Ignacio Olazabal et al. U.S. application Ser. No. 08/805,861, filed Mar. 3, 1997 now U.S. Pat. No. 6,106,109
- INKJET CARTRIDGE FILL PORT ADAPTER, Robert J. Katon et al. U.S. application Ser. No. 08/726,587, filed Oct. 7, 1996 now U.S. Pat. No. 5,874,972
- PERIODIC INK REPLENISHMENT STATION WITH REMOVABLE OFF-CARRIAGE INK SUPPLY CONTAINERS, Felix-Ruiz et al. U.S. application No. 09/032,225, filed Feb. 27, 1998 now U.S. Pat. No. 6,065,829

TECHNICAL FIELD OF THE INVENTION

This invention relates to ink-jet printers/plotters, and more particularly to techniques for stopping and restarting printing operations in mid-plot while minimizing printing artifacts resulting from stopping in mid-plot.

BACKGROUND OF THE INVENTION

Swath printers/plotters are in widespread use today for printing many types of images. A printing system suitable for a printer is described in U.S. Pat. No. 5,745,137, which employs off-carriage ink reservoirs connected to on-carriage print cartridges through flexible tubing. The off-carriage reservoirs continuously replenish the supply of ink in the internal reservoirs of the on-carriage print cartridges (or "printheads" or "pens"), and maintain the back pressure in a range which results in high print quality. While this system has many advantages, there are some applications in which the relatively permanent connection of the off-carriage and on-carriage reservoirs via tubing is undesirable.

An ink delivery system (IDS) for printers has been developed, wherein the on-carriage reservoir of the printhead is only intermittently connected to the off-carriage reservoir to "take a gulp" and is then disconnected from the off-carriage reservoir. No tubing permanently connecting the on-carriage and off-carriage elements is needed. The above-referenced related applications describe certain features of this "take a gulp" ink delivery system.

When an inkjet printer starts a print using a multi-pass print mode, the top of the page is printed with just a few nozzles of the printheads, the print medium is advanced a short distance, a few more nozzles are printed, and the print medium is again advanced a short distance, and so on. When the printer is printing normally during a print or plot using a multi-pass print mode, there are several partially formed swaths (groups of rows of pixels) with some pixels printed, and others not yet printed. At the end of a plot, the printer completes all pixels of all rows before stopping.

The take-a-gulp system as well as other large scale plotters can be employed to print large color images, wherein significant volumes of the colored inks can be used from the on-carriage reservoirs during a given print. The system includes the capability of tracking the ink volume spent from one or more of the on-board ink reservoirs and thus providing a measure of the ink remaining, and detecting when a reservoir needs refilling. If this occurs while printing, and the system were to invoke a refill operation as if doing a normal pen servicing, the carriage would be moved to the service/refill station, even though the plot is not completed, and the refill operation performed. A problem is that this interruption in printing leaves the image drying for a relatively long period of time, perhaps several minutes, before printing is resumed to complete the plot. In some print media, this action creates an arti-fact, a visible horizontal band all across the page, at the area at which printing was interrupted for the refill. Additionally, the printheads cool off during this pause, and water evaporates from the printhead nozzles, which can result in different print performance when printing resumes.

There was no solution to this problem. In other platforms, printing was continued until the cartridge ran out of ink and then the machine canceled the plot. Other possible outcomes included a very visible artifact resulting from printing interruption, or not completing the print, or printing the image with a white gap and perhaps missing some information.

It would therefore represent an advance in the art to provide a technique for reducing artifacts resulting from mid-plot-pausing.

SUMMARY OF THE INVENTION

A technique is described for carrying out a mid-plot pause, e.g. to perform a refill operation after the printer has determined that the ink level of an internal reservoir of a printhead is low. The system can invoke a refill operation as if doing a normal pen servicing, which entails moving the carriage to the service/refill station, even though the plot is not completed, and performing a refill operation. This type of refill operation will sometimes be referred to herein as an "interleaved" refill. This interruption in printing leaves the image drying for a relatively long period of time, perhaps several minutes. In some medias this action creates an artifact, a visible horizontal band all across the page.

If the printer is stopped mid-plot, after printing a given pass, the image will appear as faded out due to incomplete printing over a distance corresponding to the length of the printhead nozzle array. If this partially printed area is then printed on after a delay, say for refilling, easily visible artifacts typically occur.

By simulating an "end of plot" behavior when going to refill, and commencing printing again after refilling as if it was a "start of plot," the band artifact problem can be avoided. The simulated "end of plot" behavior is to "finish" printing through a specified row of the image, completing all pixels in a normal manner, but not printing any pixels below this row. This results in an image that is completely printed up to a defined line (row), and so there will be totally clear (no dots) medium next to a fully printed image portion.

The "start of plot" behavior entails restarting the printing of the image after a mid-plot pause,. e.g. to perform a refill, with the printhead positioned mostly over the already printed portion of the image, and using only a few nozzles (just as at the top of the page) printing a pass, then advancing the paper a short distance, printing a pass using a few more nozzles, and so on. Thus, printing is resumed after a mid-plot pause without losing image information or the physical position on the paper, so the print can be completed with little or no visible artifact.

When the print medium is loaded into the printer, the user typically selects a medium type. Based on the type selected, the printhead ink type and the print quality selected, different techniques can be applied if a mid-plot refill is required. It can happen on some types of print media that using the simulated "end of plot" and "start of plot" technique creates a white line because of the dry ink repelling wet ink. To minimize this, the algorithm can be adapted to select the type of refill operation in dependence on variables, including the media type, wherein an interlaced refill scheme can be employed instead of an "end of plot" technique. The interlaced scheme is a technique wherein the multi-pass printing is stopped at the end of a printhead pass with partially formed swaths on the print medium, the refill operation is performed, and the printing is resumed almost as if no delay had occurred. Also for some print qualities on the same media, it may be more convenient to use an end of plot scheme or an interlaced one. With all these variables, a matrix of medias and print qualities is configured for choosing the algorithm to use. Alternatively, the user can directly select the type of refill technique through a front panel menu system.

Thus, in accordance with an aspect of the invention, a method is described of pausing and resuming printing operations. The method reduces print artifacts resulting from pausing and resuming the printing in mid-plot, and comprises the following steps:

determining a pause row location at which printing is to be paused;

completing the printing of all rows and all pixels from commencement of printing through the row location, and wherein no pixels in rows immediately following the row location are printed, wherein printing is completed on the image up to the row location, and the print medium is free of any printing next to the row location;

pausing the printing for a time interval; and resuming printing at a resume row location immediately following the pause row location to print only rows following the pause row, wherein wet ink is not applied to locations printed prior to the pausing.

An accordance with a further aspect of the invention, a method of pausing and resuming printing operations is described, wherein the printer supports printing on a plurality of different media types. The method comprises a sequence of the following steps:

determining a pause row location at which printing is to be paused;

selecting a first pause/resume mode or a second pause/resume mode in dependence on a set of printing parameters;

pausing printing at the pause row location in accordance with the selected one of the first pause/resume mode or the second pause/resume mode;

resuming printing after a time interval in accordance with the selected one of the first pause/resume mode or the second pause resume mode.

BRIEF DESCRIPTION OF THE DRAWING

These and other features and advantages of the present invention will become more apparent from the following detailed description of an exemplary embodiment thereof, as illustrated in the accompanying drawings, in which:

FIGS. 6A–6B are simplified flow diagrams of an exemplary print swath routine for the system.

DETAILED DESCRIPTION OF THE PREFERRED EMBODIMENT

Figure 1:
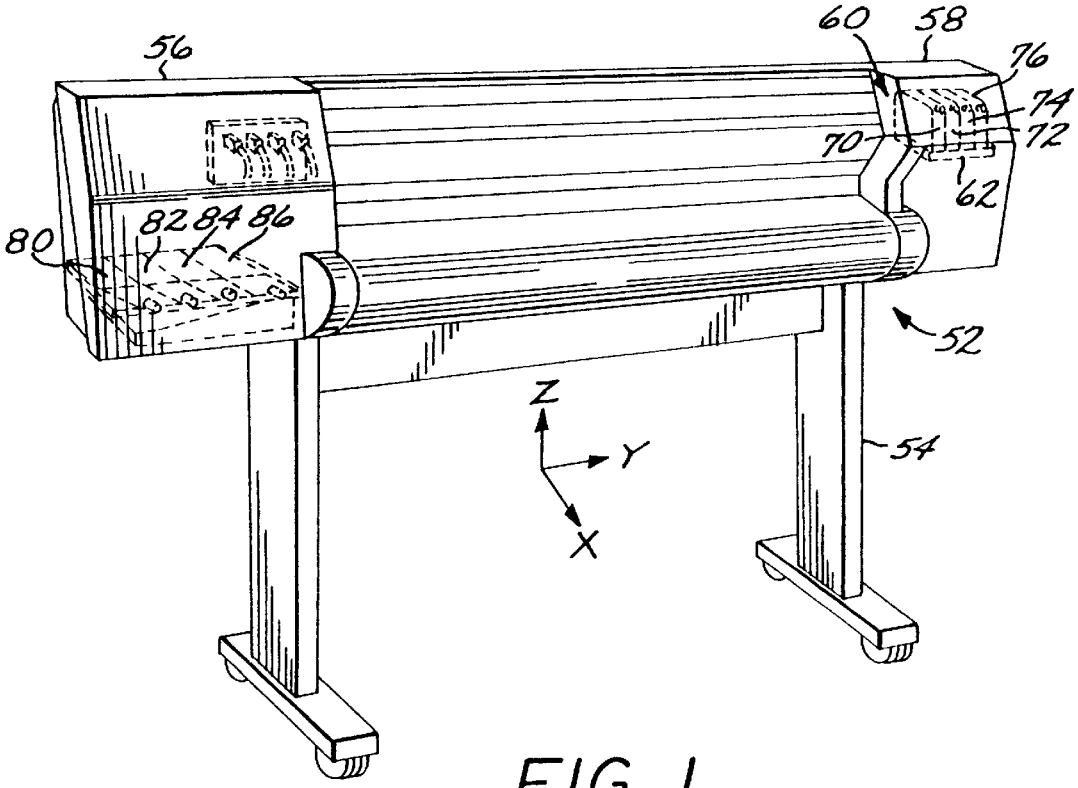
FIG. 1 is an isometric view of a large format printer/plotter system employing the invention.
Figure 2:
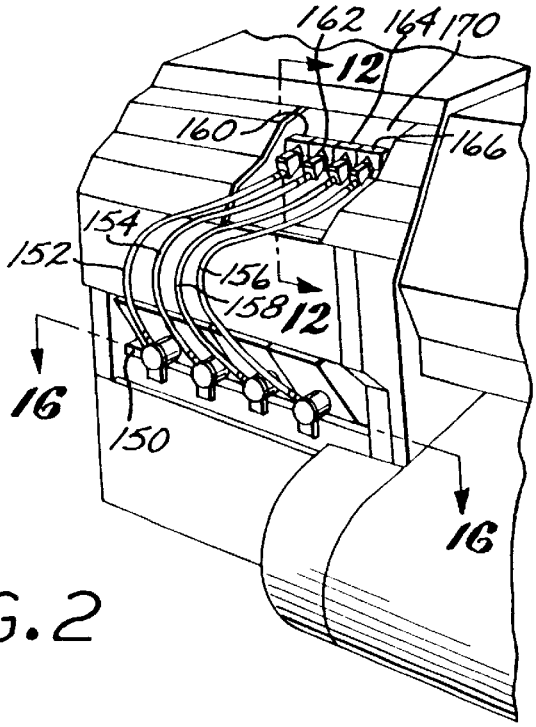
FIG. 2 is an enlarged view of a portion of the system of FIG. 1, showing the refill station.

An exemplary application for the invention is in a swath printer for large format printing (LFP) applications. FIG. 1 is a perspective view of a thermal ink-jet large format printer 50. The printer 50 includes a housing 52 mounted on a stand 54 with left and right covers 56 and 58. A carriage assembly 60 is adapted for reciprocal motion along a carriage slide rod. A print medium such as paper is positioned along a media axis by a media axis drive mechanism. As is common in the art, the media drive axis is denoted as the 'x' axis, the carriage scan axis is denoted as the 'y' axis, and the 'z' axis is oriented vertically.

Figure 3:
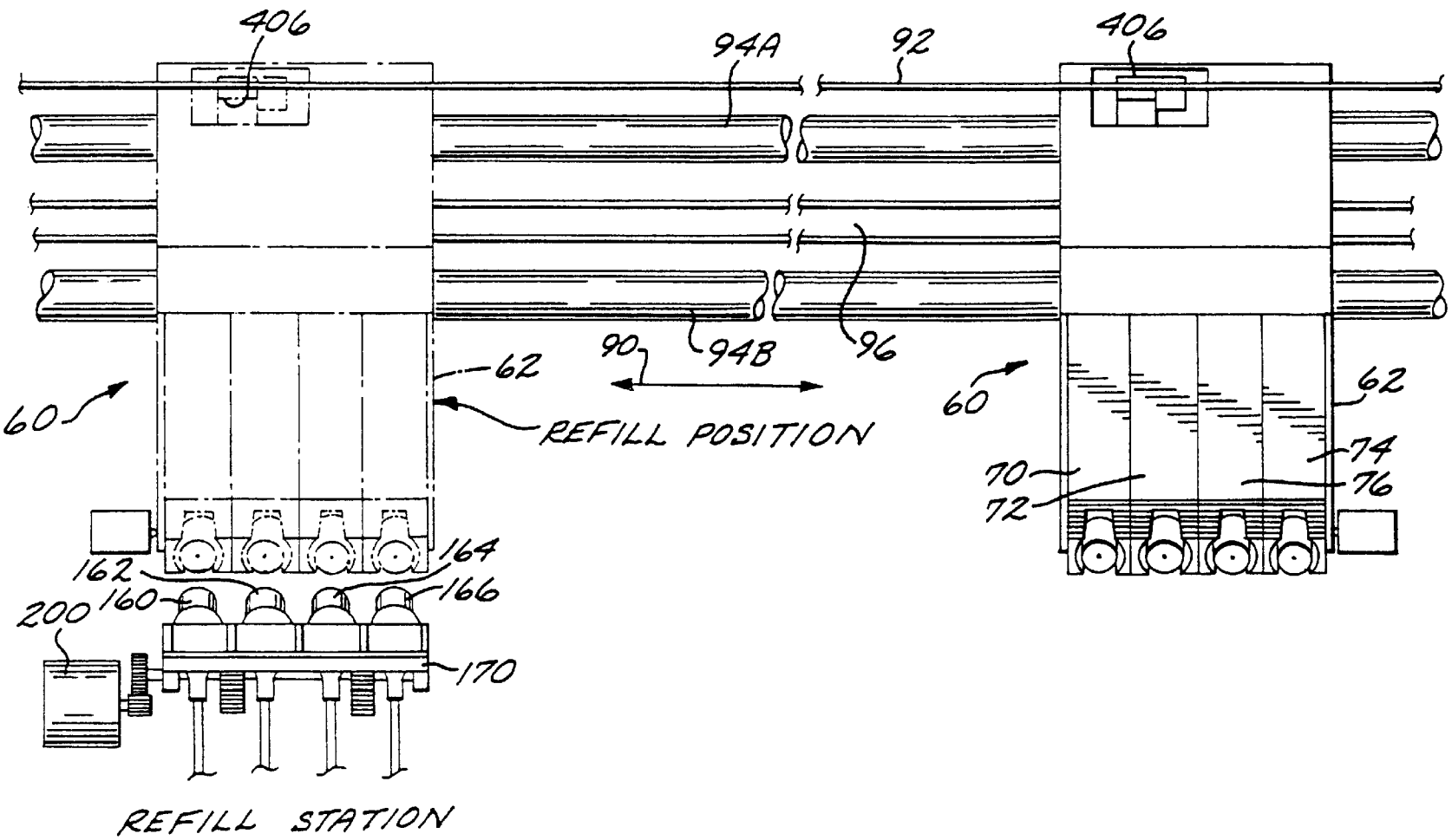
FIG. 3 is a top view showing the printer carriage and refill station.

FIG. 3 is a top view diagrammatic depiction of the carriage assembly 60, and the refill station. The carriage assembly 60 slides on slider rods 94A, 94B. The position of the carriage assembly 60 along a horizontal or carriage scan axis is determined by a carriage positioning mechanism with respect to an encoder strip 92. The carriage positioning mechanism includes a carriage position motor (FIG. 4) which drives a belt 96 attached to the carriage assembly. The position of the carriage assembly along the scan axis is determined precisely by the use of the encoder strip. An optical encoder (FIG. 4) is disposed on the carriage assembly and provides carriage position signals which are utilized to achieve optimal image registration and precise carriage positioning.

The printer 50 has four ink-jet printheads 70, 72, 74, and 76 that store ink of different colors, e.g., yellow, cyan, magenta and black ink, respectively, in internal spring-bag reservoirs. As the carriage assembly 60 translates relative to the medium along the y axis, selected nozzles in the ink-jet printheads are activated and ink is applied to the medium.

The carriage assembly 60 positions the printheads 70–76, and holds the circuitry required for interface to the heater circuits in the printheads. The carriage assembly includes a carriage 62 adapted for the reciprocal motion on the front and rear sliders 92A, 92B. The printheads are secured in a closely packed arrangement, and may each be selectively removed from the carriage for replacement with a fresh printhead. The carriage includes a pair of opposed side walls, and spaced short interior walls, which define printhead compartments. The carriage walls are fabricated of a rigid engineering plastic. The nozzle arrays of the printheads are exposed through openings in the cartridge compartments facing the print medium.

Figure 4:
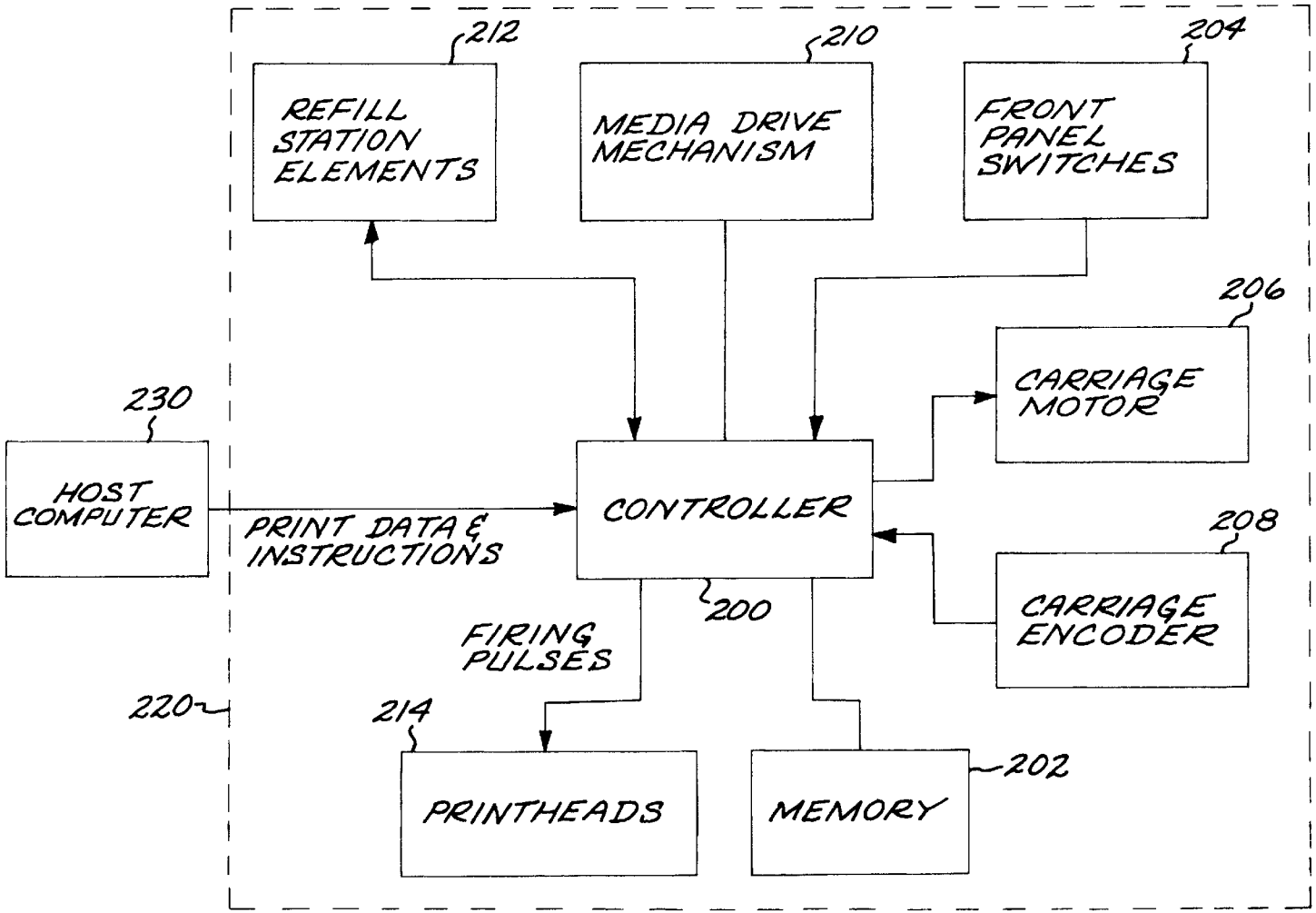
FIG. 4 is a simplified block diagram of the printer control system.

FIG. 4 is a simplified block diagram of the control system for the printer 50. Here, the elements which comprise the printer 50 indicated by enclosure within phantom line 220. These elements include the controller 200, which can comprise, e.g., a microcomputer executing program instructions, or an ASIC with firmware defining the functions to be performed by the controller. The controller is programmed to receive data signals from various sensor elements, and to issue commands to various controllable elements. For example, the controller receives carriage position signals from the carriage encoder 208, and issues drive commands to the carriage motor 206 to scan the carriage along the scan axis and to position the carriage at desired positions, e.g. at the refill station. The controller 200 also controls the various elements 212 of the refill station, including the platform motor to raise the platform supporting the off-carriage ink reservoirs, and the valve arm motor to move the valves into engagement with the print cartridges when the carriage is positioned for refill. In addition, the controller issues drive commands to the media drive mechanism 210 to advance the print medium along the media path for printing. Thus, the controller 200 positions the medium for proper position during printing, and incrementally advances the medium during printing to print successive swaths. The controller also issues firing pulses to the printheads (shown generally as printheads 214 in FIG. 4) mounted on the respective printheads. A memory 202 is provided as well for storage of various data including print swath data.

The system 50 receives print data instructions from an external source or writing system, shown in FIG. 4 as a host computer 230. Typically, the print data instructions can define a series of swaths forming a given plot, and usually do not instruct the controller prior to end of receipt of the full plot data instructions as the content of the plot. Commands are also entered by the user through front panel switches 204, e.g. via menu selection, to provide indications of the print media type and other variables.

An image is divided horizontally (i.e. along the carriage axis) in rows of pixels. Large scale printers such as the printer illustrated in FIG. 1 will typically support printing a plot image using one of several print modes. A print mode specifies how to interpret and put on media a set of bitmap planes consisting each one of a sequence of rows. This ideally includes the specification of all the parameters in the system that could affect the printing. A pass is the physical movement of the carriage along the Y axis with the purpose of putting some ink dots on media. A swath is a piece of a set of bitmap planes, and includes a contiguous number of rows to be printed.

Conventionally, all swaths have the same number of rows. In this context the swath is the unit of data that is passed to the print engine to be printed, but this piece of data has no direct relationship with the data required for each pass. The requirement of the data needed by each consecutive pass determines when the data in the current swath can be discarded and when a new swath is required. In the process of printing, there will be a set of swaths in memory, the set defining a contiguous portion of the image of width equalling the width of the image and of height equal to the amount of image rows per swath times the number of swaths in memory. The swaths are printed in several passes. For each pass, the printer takes an amount of rows to print from the current processed swaths stored in memory, selects from these rows the amount of pixels to be printed, and moves the carriage over the print area, printing the pixels selected. Then the printer may advance the print medium, or print over the same area again for the next pass. The rows are typically printed in an interleaved fashion for many color print modes.

When the printer advances the print medium, it may or may no longer need all the swaths it currently has stored in memory. When all the dots of a swath have been printed and its location is outside the printing area, the swath is no longer needed; thus its allocated memory can be freed. If the amount of rows a printhead can print is larger than the amount of rows of all swaths in memory, the printer will wait until new swaths arrive from the writing system, and then print at least one more pass.

Each advance of the print medium may lead to freeing none, one or several swaths, depending on the print mode. The printer controller includes a counter which reflects the minimum row number needed for a swath to be in memory. This minimum row number is a variable which increments every time the print medium advances. In this exemplary embodiment, the medium is advanced always in the same direction, from inside the printer to outside, so that with every advance, some rows are out of the printing area and can be deleted from memory. The printing area is the area that the printhead can print in one pass with all its nozzles. Because the rows are sorted by their physical position on the print medium, this minimum number can reflect whether a row is out of the printing area (lower than this number) or inside the printing area (greater than this number). If the row number of the row stored in memory is greater than the minimum row number variable, the row is still needed. If the row number of the row stored in memory is less than the minimum row number variable, it is no longer needed, as either its pixels have all been printed or the medium has been advanced past the location at which the row pixels was to have been printed. As soon as all the rows of a swath are no longer needed, the memory locations for that swath can be freed, and used for a newer swath. Each time the medium is advanced by an amount of rows, the counter is increased by the same number of rows.

The implementation of a print mode is a sequence of physical passes; by knowing the sequence of passes and the characteristics of each pass, the printer is able to print in the corresponding print mode. The characterization of each pass should be independent of the pass relative position in the plot, to avoid special case definitions for the first and last passes and be able to specify the sequence of passes as a repetitive pattern. There is also global information in the print mode specification such as the kind of process required for each swath before printing, or the dry time required after finishing the plot. Information to specify a pass includes data describing how to select data from the bitmap planes corresponding to every pen and also how to operate every pen for printing that data. There is also global information in the pass definition such as the motion characteristics or parameters that affects the whole carriage.

The sequence of passes conforms to the following model. The sequence is a simple loop of a group of passes. In this model the first pass of the plot is pass1 and the last pass can be any of the passes in the loop. The definition of the pass (that includes the pass advance) should be independent of the plot relative position, even for the interleaved passes. It is necessary to specify how to process a swath before printing it. (This may include depletions, black extraction and other algorithms). This is typically done by specifying a sequence of functions to be called for each swath before printing it. The argument for these functions is the swath header. If it is assumed that the swaths are queued before printing, there are two points where the processing can take place, before the swath is being queued or after getting if from the queue just before printing it. Some processing may be more preferably performed in the queue entry while other processing (such as allocate a plane to perform a black extraction) is more suitably done just before printing, keeping only one black plane for all swaths. The just-described print mode features are described as background to the operation of the printer 50.

As mentioned above, full color printing and plotting requires that the colors from the individual printheads be applied to the media. This causes depletion of ink from the internal printhead reservoirs. The printer 50 includes four take-a-gulp ink delivery systems ("IDSs") to meet the ink delivery demands of the printing system. Each IDS includes three components, an off-carriage ink reservoir, an on-carriage print cartridge, and a print head cleaner. The ink reservoir includes a bag holding a quantity of ink, e.g. 370 ml, with a short tube and refill valve attached. Details of a ink reservoir bag structure suitable for the purpose are given in co-pending application Ser. No. 08/805,860, SPACE-EFFICIENT ENCLOSURE SHAPE FOR NESTING TOGETHER A PLURALITY OF REPLACEABLE INK SUPPLY BAGS, by Erich Coiner et al. These reservoirs are fitted on the left-hand side of the printer (behind the door of the left housing 58) and the valves attach to a valve holder arm, also behind the left door, as described more fully in application Ser. No. 09/032,746, filed Feb. 27, 1998 now U.S. Pat. No. 6,099,112 entitled CARRIAGE STABILIZATION DURING PERIODIC VALVE ENGAGEMENT FOR PRINTHEAD REPLENISHMENT, the entire contents of which are incorporated herein by reference. The printhead in this exemplary embodiment includes a 300-nozzle, 600 dpi nozzle array, with an orifice through which it is refilled. The head cleaner (not shown) includes a spittoon for catching ink used when servicing and calibrating the printheads, a wiper used to wipe the face of the printhead, and a cap (used to protect the printhead when it is not in use). These three components together comprise the IDS for a given color and are replaced as a set by the user.

The proper location of each component is preferably identified by color. Matching the color on the replaced component with that on the frame that accepts that component will ensure the proper location of that component. All three components will be in the same order, with, in an exemplary embodiment, the yellow component to the far left, the cyan component in the center-left position, the magenta component in the center-right position and the black component in the far-right position.

The ink delivery systems are take-a-gulp ink refill systems. The system refills all four printheads 70–76 simultaneously when any one of the printhead internal reservoir's ink volume has dropped below a threshold value. A refill sequence can be initiated immediately after completion of the print that caused the printhead reservoir ink volume to drop below the threshold. Alternatively, in accordance with aspects of the invention, a mid-plot refill is initiated under certain circumstances as described below.

The mid-plot refill technique provides a means of stopping the printing of the plot prior to completion, moving the carriage to the refill station to replenish the ink supplies in the print cartridge reservoirs, and starting the printing of the plot again while minimizing artifacts. Preferably, refilling can be performed in different ways. For example, the machine needs to be able to do a simulated "end of plot" or "sharp end plot", as at the end of plot, or to go to refill as it was a normal servicing, using the "interleaved" refill technique described above. One of these two types of refill will be chosen, in dependence on the media type on which the plot is being made.

A mid-plot pause/refill technique in accordance with the invention can be implemented in an exemplary embodiment by adding an automaton, i.e. a state machine, into the machine print swath routine. This automaton will end with all swaths in memory if necessary, interrupt the plot printing, refill the printhead reservoirs and start the plot printing again. If a "sharp end plot" refill is performed, all swaths in memory will be printed before the printheads are refilled. If an "interleaved" refill is performed, the printer need not print all swaths before refilling, and can go to refill at the end of a pass, resuming printing on the next pass after refilling.

In an exemplary embodiment, a state machine can be configured at the beginning of the plot to implement a "sharp end plot" type of refill, or an interleaved type of refill. This is done in dependence on the type of print media, the print quality selected and the particular print mode. These parameters can be indicated by a front panel menu selection, or by data received from the writing system, for example.

Figure 5:
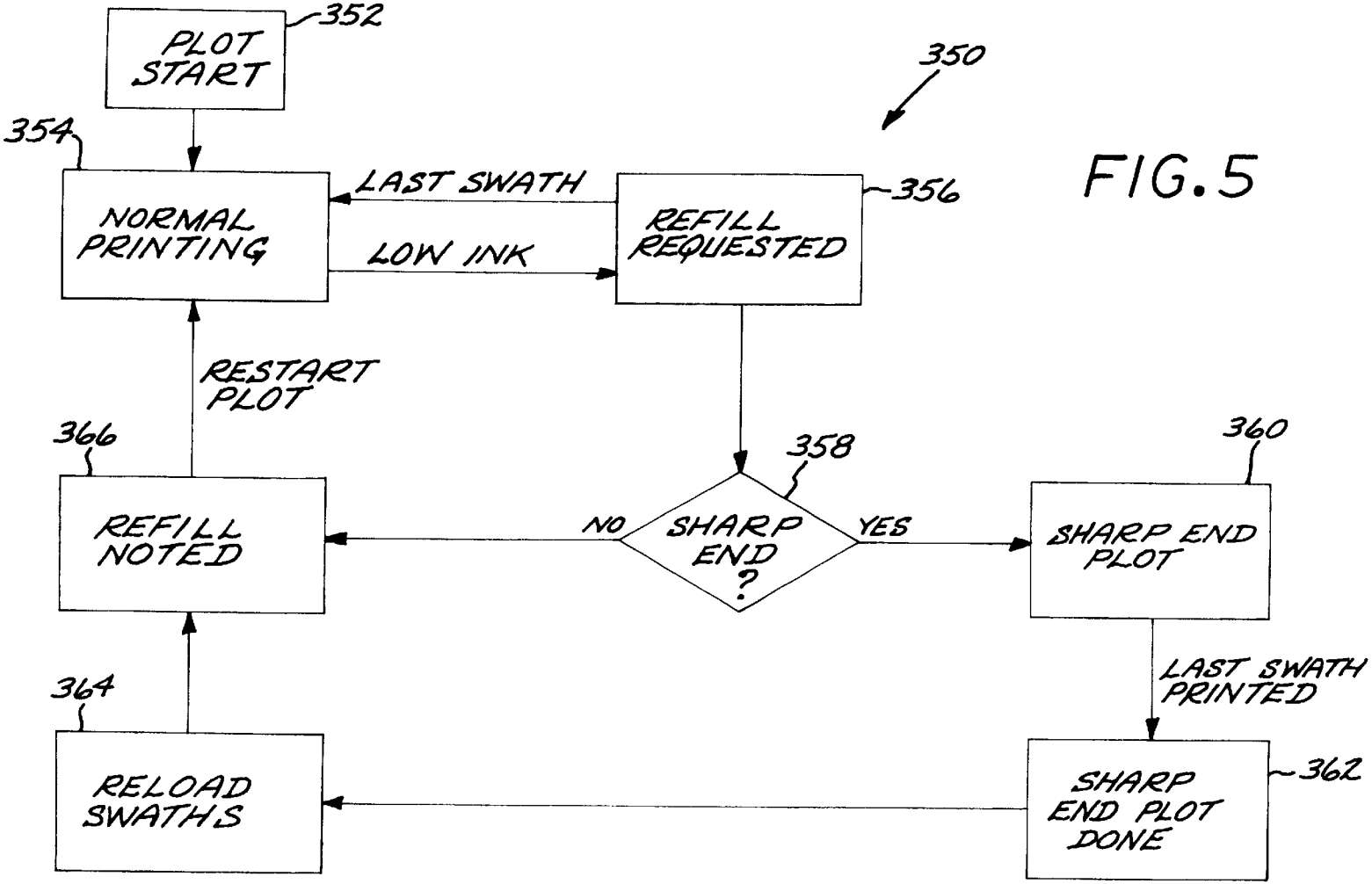
FIG. 5 is a simplified state diagram illustrative of the operation of the state machine which controls how the mid-plot refill operation is performed in an exemplary embodiment.

FIG. 5 is a simplified state diagram illustrative of the operation of the automaton in an exemplary embodiment. At the start of a plot (352), the state machine 350 is initialized to the "normal printing" state (354). The state machine can remain in this state during all the plot (if a mid-plot refill is not needed), or if a mid-plot refill is needed (low ink condition), the state machine will transition to the "refill requested" state 356. At this state, it is known that a refill is desired, but for minimizing print artifacts, it might not be desirable to immediately stop printing because the printing is in a very dark area, and it is desirable to wait to refill, e.g. for a blank swath or a low ink density location in the plot. In an exemplary embodiment, the printer controller determines the appropriate time/location to perform a mid-plot refill operation in accordance with an adaptive refill trigger technique as described in application Ser. No. 09/183,129, now U.S. Pat. No. 6,106,108 ADAPTIVE IMAGE-BASED TECHNIQUE FOR REFILL-WHILE-PRINTING TRIGGERING. Alternatively, the mid-plot pause technique can be invoked for other reasons, e.g. loss of data from the host, or if the internal raster image processor is too slow to maintain pace with the printer. Moreover, the need for a refill can be determined by techniques other than those described in this co-pending application.

When the adaptive refill trigger process decides it is time to do a refill, the state machine 350 will transition to either a "sharp end plot" state 360 to finish as a normal end of plot, or directly to "refill noted" (366) to stop at the end of the current pass and refill the pens to perform an interleaved refill operation.

When "sharp end plot" is selected at 358, a "final swath" flag is set to true at state 360, and the print swath loop will continue to print until the counter of the data needed to print is greater than the row numbers contained in all the swaths still in memory, i.e. until all the data in the swaths has been printed and there are no more swaths remaining to be printed up to the current part of the image. When there is no more data for the pass, the state machine goes out of the print swath loop, transitioning to state 362 ("sharp end plot done") and the final swath flag is set to false. This is done to avoid starting any "end of plot" actions. This is what "end plot done" will do. At state 364, the printer process which generates swaths to print is requested to generate more swaths in order to have enough data to print the following pass once the printhead reservoirs have been refilled. The state machine transitions to the "refill noted" state 366. All the actions needed for the refill can be performed, including pre-refill pen servicing, post-refill pen servicing.

At step 358, if the "sharp end plot" type of refill is not to be performed, or there is insufficient data for the pass, an interleaved refill operation is performed by transitioning directly to the "refill noted" state 366.

Once refill is done, operation returns to the "normal printing" state 354. Now printing again is performed in a normal state, and the printer behaves as one that does not use mid-plot refill algorithms.

In an exemplary embodiment, the controller includes a pen manager process which keeps track of the amount of ink remaining in each printhead (or more typically, the amount of ink spent from each printhead and thereby inferring the amount of ink remaining), and changes the state of the automaton from "normal printing" to "refill requested" when a threshold is reached. The pen manager process checks to determine whether refill is needed at every pass end. If the pen manager process has already requested a refill, or the system is not in the normal printing mode, no actions will be taken because the system is in the process of performing a refill.

In an exemplary embodiment, the controller implements a print mode engine to provide the capability of printing in different modes and to carry out the necessary functions to print a plot with a particular print mode. Each print mode reflects the combination of print quality, data resolution, number of colors used (black, cyan, magenta, yellow), and the data contents. There are different ways of printing, i.e the number of passes and the manner in which dots are put on the print medium for each pass, for each combination of the variables, print quality (best, normal, fast), data resolution (300 dpi, 600 dpi), number of colors (black only; cyan, magenta and yellow only; all four colors), data contents (vector, raster, both). The print mode engine initializes the state machine 350 at the beginning of a plot to the "normal printing" state and to the kind of mid plot refill strategy to use, i.e. whether to use a sharp end plot or an interleaved refill, as well as the duration of the refill operation. No refill will be done if the pen manager process does not request a refill.

Before starting to print a new swath (as distinct from a new pass) the system checks to determine if the state machine is in the "refill requested" state. A "sharp end plot" type of refill is performed only between swaths; an interleaved type of refill operation can be performed without freeing up swaths, i.e. between passes. At this point, the system is printing, and will keep printing until the last swath arrives or there is the possibility of doing a refill (low density swaths, empty swaths or other predetermined circumstance in which to perform a refill). When this happens, depending on the selected configuration of the refill, i.e. the refill technique to be applied based on the medium type, ink type and print quality level, the process is either started of emptying the swath queue of swaths and finishing the plot ("sharp end plot" refill), or else the system goes directly to the "refill noted" state for an interleaved refill. The pen manager routine is informed of the possibility of doing refill once the intermediate process at the end of the swath is completed by means of reading the state of the machine 350.

Additional information can be used to decide which refill process to use, e.g. the print medium type, the ink type and the customer selected print quality type. In an exemplary embodiment, the printer can select the amount of time the printheads will spend in refill. This allows an adjustment for the different ink/media interactions obtained on different print media. In this embodiment, the printer has two settings, a "slow" setting of about 2.5 minutes for a refill, and a "fast" setting of about 90 seconds which does not fill the printhead reservoir to the extent the "slow" setting would. Refill thus may need to be performed more often for a very large plot.

FIG. 6 shows a generalized top level flow diagram for the print swath routine in a normal printing mode. This generalized process 300 commences at 302 with receipt of a print file from the user/host, e.g. the host computer 230 (FIG. 4). At 304, the printer system 50 parses the data in the input file and translates it into printable data, i.e. a rasterization process. The plot is started at 306 in a normal printing state.

At 308, the routine performs a check on the ink levels in the printhead reservoirs. If any one of the printhead reservoirs is low on ink and the last swath flag is set to false, the "refill requested" state is set at 310. If for the given media type and other parameter variables, it has been determined that a "sharp end plot" type of refill operation is desired, then the "sharp end plot" state is set, and the "last swath" flag is set true (step 316). Operation then branches to step 318. On the other hand, at step 312 if a "sharp end wanted" decision is negative, then the "refill noted" state is noted (step 314) and the operation has moved to step 318.

At step 318, if not in the "sharp end plot done" state, operation will proceed to step 322. If a sharp end plot is performed and all swath data in memory has been printed, the algorithm reloads swath data for the pass next following the refill operation (step 320). At step 322, if enough data is available to print a pass (steps 322, 324), operation proceeds to decision 326, to determine if the swath reloading is performed. If yes, then at 325, the "refill noted" condition is indicated, at 327 a refill operation on the pens is performed, and the normal printing state is now indicated at 329. At 328, a pass is started, and the pass is printed (330). A pen servicing is performed (334) if needed. This includes several functions, including operations described in co-pending applications Ser. No. 09/120,682, filed Jul. 21, 1998, allowed, entitled VARIABLE MAXIMUM OPERATING TEMPERATURE FOR A PRINTHEAD, and U.S. Pat. No. 09/120,858, filed Jul. 21, 1998, entitled SELECTIVELY WARMING A PRINT-HEAD FOR OPTIMIZED PERFORMANCE. After pen servicing, the system checks to see whether the "refill noted" state exists (step 336) (as opposed to the "normal printing" state). If so, then a pen refill operation is performed at 338, and the normal printing state is resumed at 339.

The ink level counters which keep track of the ink level in each printhead are updated (340). Once the end of the pass has been reached (342), the operation proceeds to a decision (343) as to whether the "sharp end plot" has been performed. If affirmative, the "sharp end plot done" flag is set, and the last swath flag is set to false (step 344). If not the operation proceeds to step 345 to determine whether more printable data is available. If the process determines that more printable data is available for the plot, operation returns to step 308. If there is no more printable data, the end of plot has been reached (346). If the ink level in a printhead is low, as determined at step 347, an end-of-plot refill procedure is performed (step 348). The printer is now ready for another plot (349).

In FIG. 6B, the steps 326, 325, 327, 329 indicate the refill operations performed with the sharp end plot behavior. Steps 336, 338, 339 indicate the refill operations performed for an interleaved refill operation.

Figure 6A:
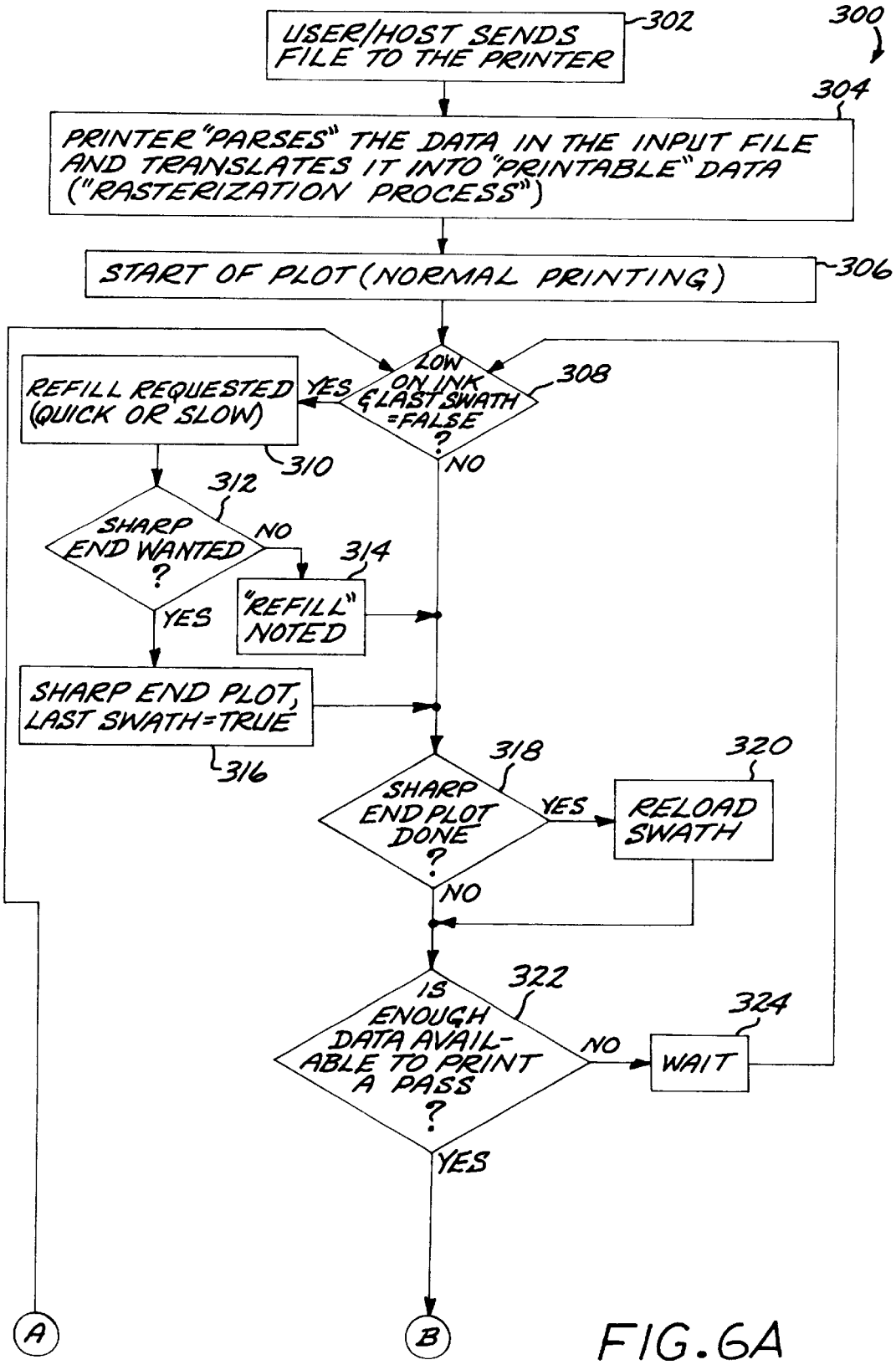

As an example of the process shown in FIGS. 6A and 6B, consider the situation in which the low on ink state is true at step 308. On this pass through the routine, the last swath flag state will be false, and so operation will proceed to step 310 to set the "refill requested." Assume that a sharp end is desired. Then at step 316 the sharp end plot state is set, and the last swath flag is set to true. At 318, the decision will be no, since a sharp end has been requested. At 322, there is enough data for printing a pass, and so the decision is yes. At 326, the decision is "no," and a pass is started and printed (328, 330). After pen servicing (334), the decision at 336 is no, and the ink level counters are updated (340), and the pass is completed (342). At 343, the decision is no, and operation will loop back to 308 since there is more data to print. Now, at 308, the decision is no (last swath flag is true), and at 318 that the sharp end done state is yes, and the swaths are loaded at 320. When step 322 is reached, the answer is yes, and also at 326. Now the refill noted state is set, the pens are refilled at 327, and the normal printing state is set at 329. The new pass is started (340) and after the end of the pass (342), at decision 343, the answer is yes. The sharp end plot done state is set at 344, and the last swath flag is set to false. Operation then continues, returning to 308 if there is more data to print (345) or to end of plot (346) and subsequent steps (347–349).

It has been empirically determined that for different medium types, different kinds of refill are needed. Depending on the print medium and print quality selected, there is an optimum combination of the "sharp end plot" refill, the "interleaved" refill, and "fast" or "slow" refill operations which is not the same for all types of print quality. Depending on the print quality and the print medium type, the algorithm can select four different ways of refilling, interleaved/fast, interleaved/slow, sharp end plot/fast and sharp end plot/slow. Depending on the print media and print quality (fast or slow), more or less time can be taken at the refill station for the refill process in order to not let the paper dry to much. For example, fast refill is used for vinyl medias. Table 1 sets out a decision matrix for determining how the mid-plot refill operation will be performed in dependence on the type of media and the print quality specified for the plot.

TABLE 1

Media/Quality Refill while plotting decision matrix

| Media | Best Quality | Normal Quality | Fast Quality |
|---|---|---|---|
| HIGH_GLOSSY_PHOTO | SLOW SHARP | SLOW SHARP | SLOW SHARP |
| GLOSSY_FILM | SLOW SHARP | SLOW SHARP | SLOW SHARP |
| SEMI_GLOSSY_PHOTO | SLOW SHARP | SLOW SHARP | SLOW SHARP |
| COATED_PAPER | SLOW INTERLACED | SLOW SHARP | SLOW SHARP |
| HEAVYWEIGHT-COATED | SLOW INTERLACED | SLOW INTERLACED | SLOW SHARP |
| BACKLIT | SLOW INTERLACED | SLOW INTERLACED | SLOW INTERLACED |
| VINYL | QUICK INTERLACED | QUICK INTERLACED | QUICK INTERLACED |
| UV_OPAQUE_VINYL | SLOW SHARP | SLOW SHARP | SLOW SHARP |
| UV_HEAVYWEIGHT_COATED | SLOW INTERLACED | SLOW INTERLACED | SLOW INTERLACED |

The "sharp end of plot" can be implemented in the set of states "refill requested" 356, "sharp end plot" 360 "sharp end plot done" 362, "reload swaths" 364, and "go refill" 366. The system can only go to refill while plotting and implement a "sharp end of plot" if the last swath of the image has not arrived to the print mode engine. When this last swath arrives, the system has enough ink to finish the plot without the need for performing a refill. The last swath is marked with a flag.

If the client, i.e. the host computer, of the Writing system ("WS") sends a swath to print, the print mode engine calls the print Swath routine. This routine implements the simulated end and start of plot. The print swath routine among other things is a loop that, while it has data to print, performs a pass and advances the paper and some pointers to the data according to the logical paper advanced. Before entering this loop, the system checks to determine if a refill has been requested by the pen manager routine. If no refill is requested, the print swath loop is entered normally, and a pass is printed. But if a refill has been requested, the print swath loop is informed that the last swath has arrived; this is not true but forces an "end of plot" condition.

When the print swath loop gets the "last" swath, it causes to be printed all the data in the print mode engine data queue. At this time the data pending printing has been printed, so that the loop ends and seeks to obtain more swaths. Just at the end of the loop, the last swath condition is restored to false, because it is not desired to start the end of plot dry time, servicing or any other action that take place at the end of a plot. The control process does not consider that the plot has been finished and the print mode engine considers that it only needs more data, and gets a new swath from the client.

Again, before entering the print swath loop, a check is made to determine whether an "end of plot" has been done, and the data pointers used to print are set to simulate as if a new plot has started, taking in account the current position of the pen, the paper, and the plot on the paper. Combining all these three variables, the position of the new plot is set in the next data line not printed that will be on the next white space of paper.

When ready to print the new pass, the print mode engine is allowed to take control of the carriage and go to refill. As soon as it ends the refill, the first pass of the new plot is performed, and neither the pen manager, the print mode engine or the WS client will have noticed that an end of plot and a start of plot have happened. This can be iterated as many times as desired inside a plot.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A method of pausing and resuming printing operations with a swath printer having a movable carriage mounting a printhead including an array of print nozzles, the carriage movable across a print area along a swath direction in a sequence of swaths each constituting one or more passes of the carriage across the print area to print rows of image pixels, the method comprising:

commencing printing in a multi-pass print mode wherein the rows constituting a swath are printed during a plurality of passes in an interleaved manner;

determining a pause row location at which printing is to be paused;

completing the printing of all rows and all pixels from said commencement of printing through said row location, and wherein no pixels in rows immediately following said row location are printed;

pausing said printing for a time interval; and resuming said printing at a resume row location immediately following said pause row location to print only rows following said pause row, wherein wet ink is not applied to locations printed prior to said pausing.

2. The method of claim 1 wherein the printer is further adapted to use during said multi-pass printing mode a start of plot behavior to commence printing an image wherein during a first pass only a subset of said print nozzles is employed, relative motion is provided between the print medium and the carriage, a successive pass is printed wherein only a second subset of the nozzles is employed, and the process repeated until a normal printing state is established, and wherein:

said resuming step includes simulating said start of plot behavior commencing at said resume row location.

3. The method of claim 1 wherein the printer is further adapted to use an end of plot behavior to complete printing an image using said multi-pass printing mode wherein the printing transitions from a normal printing mode in which all nozzles can be employed in printing during a swath to using only a subset of said print nozzles during a first pass, relative motion is provided between the print medium and the carriage, a successive pass is printed wherein only a second subset of the nozzles comprising fewer of the nozzles than the first subset are employed, and the process repeated until the last row of the image has been plotted, and wherein:

said step of completing the printing through said pause row location includes simulating said end of plot behavior as if said pause row location were the end of the plot.

4. The method of claim 1 further comprising the step of servicing said printhead during said time interval.

5. The method of claim 4 wherein the step of servicing said printhead includes replenishing an ink supply associated with said printhead.

6. The method of claim 1 wherein said printer supports printing on a plurality of media types, and further comprising the step of:

selecting said time interval independence on said media type, wherein a long time interval is selected for a first media type and a short time interval is selected for a second media type.

7. A method of pausing and resuming printing operations using an on-carriage printhead in a printer having a movable carriage mounting the print cartridge, the carriage movable across a print area along a swath direction in a sequence of swaths each constituting one or more passes of the carriage across the print area to print rows of image pixels constituting an image, and wherein relative movement is provided between the print medium and the carriage in a direction transverse to the swath direction and wherein the printer supports printing on a plurality of different media types, the method comprising a sequence of the following steps:

determining a pause row location at which printing is to be paused;

selecting a first pause/resume mode or a second pause/resume mode in dependence on a set of printing parameters;

pausing printing at said pause row location in accordance with said selected one of said first pause/resume mode or said second pause/resume mode;

resuming printing after a time interval in accordance with said selected one of said first pause/resume mode or said second pause resume mode.

8. The method of claim 7 wherein said set of printing parameters includes print media type.

9. The method of claim 7 wherein said set of printing parameters includes print quality mode.

10. The method of claim 7 wherein the printer is adapted to print an image using a multi-pass print mode in which the rows constituting a swath are printed during a plurality of passes in an interleaved manner, and wherein said first pause/resume mode includes interrupting the printing at said pause row location, wherein printing is not completed for all rows between a start row and said pause row prior to said printing interruption, and said step of resuming printing includes completing printing on rows between said start row and said pause row.

11. The method of claim 7 wherein the printer is adapted to print an image using a multi-pass print mode in which the rows constituting a swath are printed during a plurality of passes in an interleaved manner, and wherein said second pause/resume mode is adapted to complete all printing through the pause row location without printing any rows succeeding the pause row location prior to said pausing, wherein said step of pausing printing includes printing all rows of the image through the pause row location prior to said pausing, and said step of resuming includes printing only rows following the pause row location.

12. The method of claim 11 wherein the second pause/resume mode simulates an end of plot behavior prior to said pausing, and simulates a start of plot behavior upon resuming said printing.

13. The method of claim 7 further comprising the step of servicing said printhead during said time interval.

14. The method of claim 13 wherein the step of servicing said printhead includes replenishing an ink supply associated with said printhead.

15. The method of claim 7 further comprising the step of:

selecting said time interval in dependence on said media type, wherein a long time interval is selected for a first media type and a short time interval is selected for a second media type.

16. A method of conducting a refill operation in an on-carriage printhead in a printer having a movable carriage mounting the print cartridge, the carriage movable across a print area in a sequence of passes to print a plot image, the printer including an off-carriage ink supply available for intermittent connection to the internal reservoir of the printhead for the refill operation, and a controller for determining whether a refill operation needs to be performed during the printing of the plot image and the appropriate location in the plot for which the printing should be interrupted, and wherein the printer supports printing on a plurality of different types of print media, the method comprising the following steps:

completing a pass of the carriage across the print area;

moving the carriage to a refill station;

conducting a refill operation to replenish an ink supply within the internal reservoir, the length of the refill operation and the amount of ink transferred to the internal reservoir during the refill operation dependent on the type of print media on which the image plot is being printed; and resuming printing of the image plot.

17. A method of pausing and resuming printing operations using an on-carriage printhead in a printer having a movable carriage mounting the print cartridge, the carriage movable across a print area along a swath direction in a sequence of swaths each constituting one or more passes of the carriage across the print area to print rows of image pixels constituting an image, and wherein relative movement is provided between the print medium and the carriage in a direction transverse to the swath direction, the printer supporting printing on a plurality of media types, the method comprising the following steps:

determining a pause row location at which printing is to be paused;

completing the printing of all rows and all pixels from commencement of printing through said row location, and wherein no pixels in rows immediately following said row location are printed, wherein printing is completed on the image through said row location, and the print medium is free of any printing following said row location;

pausing said printing for a time interval selected in dependence on said media type, wherein a long time interval is selected for a first media type and a short time interval is selected for a second media type;

conducting a refill operation during said pausing to transfer ink from an auxiliary ink supply to said printhead;

resuming said printing at a resume row location immediately following said pause row location to print only rows following said pause row, wherein wet ink is not applied to locations printed prior to said pausing.

18. A method of pausing and resuming printing operations with a swath printer having a movable carriage mounting a printhead including an array of print nozzles, the carriage movable across a print area along a swath direction in a sequence of swaths each constituting one or more passes of the carriage across the print area to print rows of image pixels, the printer supports printing on a plurality of media types, the method comprising:

commencing printing in a multi-pass print mode wherein the rows constituting a swath are printed during a plurality of passes in an interleaved manner;

determining a pause row location at which printing is to be paused;

completing the printing of all rows and all pixels from said commencement of printing through said row location, and wherein no pixels in rows immediately following said row location are printed;

pausing said printing for a time interval, said time interval selected in dependence on said media type, wherein a long time interval is selected for a first media type and a short time interval is selected for a second media type; and resuming said printing at a resume row location immediately following said pause row location to print only rows following said pause row, wherein wet ink is not applied to locations printed prior to said pausing.

19. A method of pausing and resuming printing operations with a swath printer having a movable carriage mounting a printhead including an array of print nozzles, the carriage movable across a print area along a swath direction in a sequence of swaths each constituting one or more passes of the carriage across the print area to print rows of image pixels, the method comprising:

commencing printing in a multi-pass print mode wherein the rows constituting a swath are printed during a plurality of passes in an interleaved manner;

determining a pause row location at which printing is to be paused;

changing from said multi-pass print mode to a refill print mode different from said multi-pass print mode to complete the printing of all rows and all pixels from said commencement of printing through said row location, and wherein no pixels in rows immediately following said row location are printed;

pausing said printing for a time interval; and resuming said printing at a resume row location immediately following said pause row location to print only rows following said pause row.

20. The method of claim 19, wherein said refill print mode simulates a print mode used to end a plot.

* * * * *